United States Patent [19]

Busch et al.

[11] Patent Number: 4,909,076

[45] Date of Patent: Mar. 20, 1990

[54] CAVITATION MONITORING DEVICE FOR PUMPS

[75] Inventors: Dieter Busch, Ismaning; Heinrich Lysen, Munich, both of Fed. Rep. of Germany

[73] Assignee: Prüftechik, Dieter Busch & Partner GmbH & Co., Ismaning, Fed. Rep. of Germany

[21] Appl. No.: 228,240

[22] Filed: Aug. 4, 1988

[30] Foreign Application Priority Data

Aug. 4, 1987 [DE] Fed. Rep. of Germany ..... 3725754

[51] Int. Cl.[4] ..... G01G 13/00; H03B 5/32

[52] U.S. Cl. ..... 73/168; 73/652; 310/318; 417/318

[58] Field of Search ..... 73/168, 584, 587, 652; 374/117; 417/205, 63; 310/318

[56] References Cited

U.S. PATENT DOCUMENTS

| | | | |
|---|---|---|---|
| 1,614,573 | 1/1927 | Regelein et al. | 73/652 |
| 2,896,447 | 7/1959 | Phillips et al. | 73/652 |
| 3,443,797 | 5/1969 | Branson | 366/46 |
| 3,910,216 | 10/1975 | Shultz | 340/8 R |
| 4,025,238 | 5/1977 | Masclet | 417/251 X |
| 4,311,436 | 1/1982 | Hendriks | 417/63 X |
| 4,323,077 | 4/1982 | Smith | 128/660 |
| 4,492,113 | 1/1985 | Weatherholt | 73/168 X |
| 4,512,722 | 4/1985 | Mouton | 417/205 X |
| 4,558,593 | 12/1985 | Watanabe et al. | 73/168 |
| 4,586,110 | 4/1986 | Yamamoto | 310/318 X |

*Primary Examiner*—Daniel M. Yasich

*Attorney, Agent, or Firm*—Robert W. Fiddler

[57] ABSTRACT

The invention provides a device for monitoring pumps to detect danger of damage by cavitation. One object of the invention is to provide a device for this purpose which is simple in design, is readily handled, simple to attach to the pump to be monitored and permanently and straightforwardly indicates if there is cavitation and if so to what degree. These objects are to be attained by a monitoring device for use with a pump comprising a housing with rigid wall part capable of participation in vibratory motion and having an external sensing surface for application on the wall part on a pump housing, an inertial mass arranged in the housing, a piezoelectric vibration transducer held between the inertial mass and the wall part capable of participating in vibration, said transducer being adapted to respond to vibrations of the said wall part, and electric circuitry with a display able to be seen from a point outside the housing to indicate an AC output of the piezoelectric transducer in excess of a certain threshold.

9 Claims, 3 Drawing Sheets

CAVITATION MONITORING DEVICE FOR PUMPS

BACKGROUND OF THE INVENTION

The invention relates to a cavitation monitoring device for pumps.

If a pump is liable to cavitation it may well be seriously damaged if the cavitation takes place to a pronounced degree and/or continues for a long time. Cavitation phenomena in pumps frequently only make themselves felt gradually so that the commencement of cavitation is likely to be overlooked, more especially if the room containing the pump is noisy owing to the presence of other pumps or machines. The cavitation will then only be noticed after the noise caused thereby exceeds noise from other sources. By then however the pump may well be damaged due to the long duration of cavitation. On the other hand there are cases in which a certain level or period of cavitation may be tolerated without damage to the pump However, for the stated reasons it is good practice for the pumps to be cavitation monitored.

SHORT SUMMARY OF THE INVENTION

One object of the invention is to provide a device for the specified purpose which is simple in structure.

A further aim of the invention is to devise a device which is readily used.

A still further aim of the invention is to provide a device for monitoring pump cavitation which is functionally reliable, may readily be fitted to the pump to be monitored and indicates in a continuous and straightforward manner if cavitation is taking place and if so how serious it is.

In order to achieve these or other objects appearing from the present specification, claims and drawings the novel cavitation monitoring device for use with a pump comprises a housing with rigid wall part capable of participation in vibratory motion and having an external sensing surface for application on the wall part on a pump housing, an inertial mass arranged in the housing, a piezoelectric vibration transducer held between the inertial mass and the wall part capable of participating in vibration, said transducer being adapted to respond to vibrations of the said wall part, and electric circuitry with a display able to be seen from a point outside the housing to indicate an AC output of the piezoelectric transducer in excess of a certain threshold.

Owing to the use of present day small electronic components the device in accordance with the invention may be accommodated in a small and compact housing because the inertial mass and the vibration transducer do not require any substantial amount of space. Such a compact device may simply be so adhesively bonded to the pump housing that a reading may be readily taken from it simply while walking past. In this respect the simple and reliable design ensures permanent and dependable serviceability.

In order to further enhance such serviceability and functional reliability the vibratory system comprising the transducer is so tuned that it resonates when cavitation takes place in the pump to be monitored. A vibration due to cavitation has a very broad harmonic spectrum extending into the high frequency range. This characteristic of the cavitation vibration is used to produce a particularly large output voltage from the vibration transducer.

In accordance with a further feature of the invention the display has a plurality of adjacent display segments and the circuitry has a number of subcircuits, equal to the number of display segments, set to different threshold values and fed by the transducers for cooperation with one specific display segment. This feature makes it possible not only to detect the condition of initial or chronic cavitation but furthermore to indicate the severity of cavitation already in progress and thus to put the pump minder in a position of deciding whether some action should be taken or whether it is possible to wait and see whether the cavitation will not cease of its own accord under the given operating conditions.

The display may be an LCD display having its segments contiguous with each other so that when a respective segment-specific threshold value is exceeded such segment appears as a dark area.

The display may be such that it responds to the unamplified output voltage of the vibration transducer. In other words, the device does not require any power supply such as a battery and may thus be operated practically without any servicing.

A permanent magnet may be incorporated in the housing to retain the wall part, capable of vibrating, on a ferromagnetic part of the pump housing. This provides a particularly simple fashion of bonding the device of the invention to a pump housing since the magnet is able to hold the device in place until the adhesive has cured without having to wait or to employ external retaining means.

The invention will now be described in more detail with reference to a preferred embodiment thereof.

LIST OF THE SEVERAL VIEWS OF THE FIGURES

DETAILED ACCOUNT OF PREFERRED EMBODIMENT OF THE INVENTION.

Figure 1:
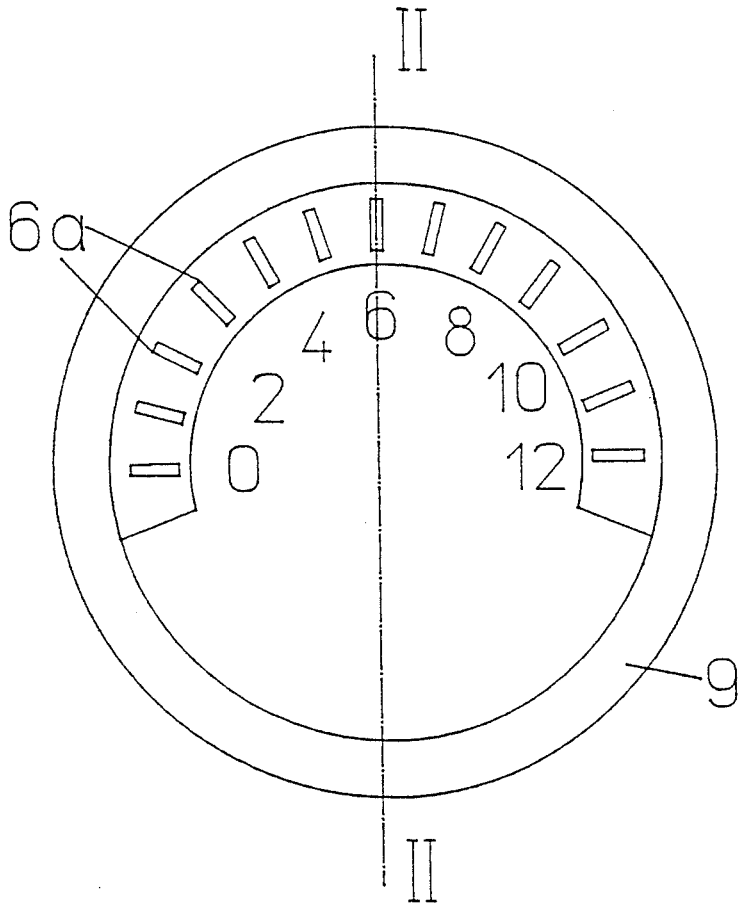
FIG. 1 shows the device as seen from the front and looking towards the display.
Figure 2:
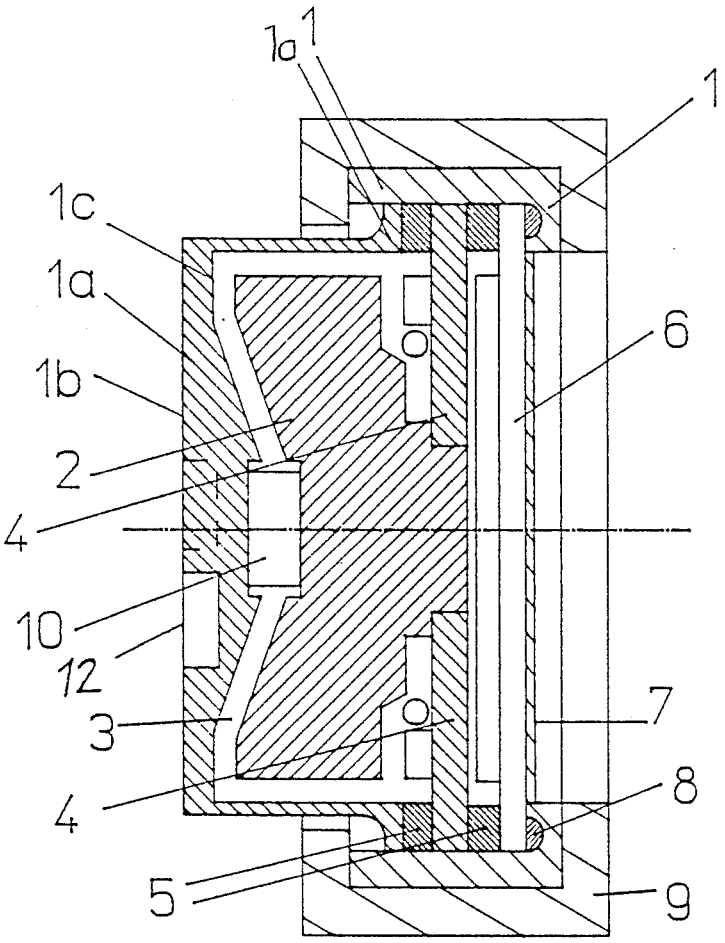
FIG. 2 is a cross section taken through the device of FIG. 1 on the section line II—II of FIG. 1.
Figure 3:
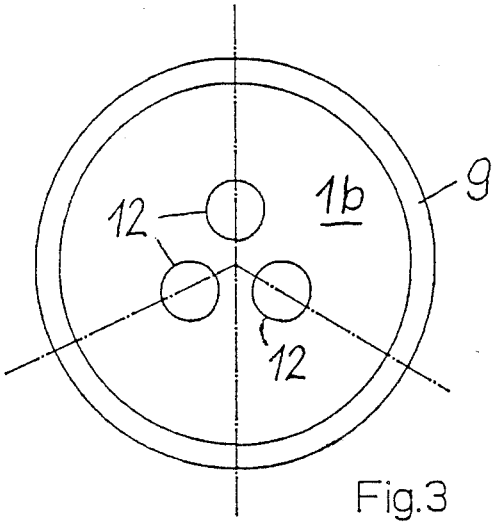
FIG. 3 shows the device of FIGS. 1 and 2 from the rear and looking towards the sensing surface.

The device shown the drawings has a housing 1 which is provided with a wall part 1*a* extending along one side shown on the left in terms of FIG. 2. The outer surface of this wall part forms an external sensing surface 1*b*. The wall part 1*a* is so configured that owing to its low weight it may be readily accelerated and thus is capable of participating in vibrations while on the other hand it is rigid so that it fully participates in vibrations transmitted to it via the sensing surface 1*b*. This is made possible by the conical shape of the wall part 1*a*, the use of a material with a low specific gravity and high strength as for instance aluminum and by the coupling of the wall part 1*a* by flexible sections 1*c* with the rest of the housing 1.

An inertial mass 2, as for instance one of brass, is arranged in the housing 1 and fills up a large amount of the cavity enclosed by the housing 1, for which purpose it is adapted in shape to the conical form of the wall part 1*a*, towards which it extends, however leaving a gap 3 therebetween. The inertial mass 2 is centrally attached to a printed circuit board 4, which is clamped along the periphery against the housing 1 with rubber bands 5 on both sides. The circuit board 4 is thus held in the housing together with the inertial mass 2. On the other end face, to be seen on the right in FIG. 2, of the housing 1 there is a disk-like LCD display 6, which may be seen through a transparent sticker 7 from outside the housing 1. The disk-like LCD display has its periphery fitted between the rubber ring 5 and O-ring 8 and is thus also clamped against the housing 1. The arrangement is such that the space between the LCD display 6 and the wall part 1*a* is hermetically sealed. Near the periphery and a small distance towards the edges the housing 1 is provided with a guard ring 9 of soft plastic, which protects the housing 1, whose peripherally outer part towards the right hand end said may consist of a rigid plastic such a polycarbonate (e.g. in the form commercially available under the name Makrolon).

Between the inertial mass 2 and the wall part 1*a* and generally towards the middle thereof, a piezoelectric vibration transducer 10 of piezoelectric ceramic material is clamped in place firmly, i.e. with a certain preloading effect. It is accommodated in oppositely placed central recesses in these parts and so held laterally. This vibration transducer 10 is connected by electrical connections (not shown) with the electrical circuitry 11 on the circuit board 4. Such circuitry is for its part connected with the LCD display 6. The circuitry 11 distributes the AC supplied by the vibration transducer 10 among a number of segments 6*a*, placed side by side, with different threshold values so that the display segments 6*a* respond one after the other sequentially as the voltage increases. Each segment 6*a* appears, as soon as the respective threshold value is exceeded, as a dark patch so that even at some distance it is possible to see the length of a dark patch and thus to estimate the approximate degree of the cavitation occurring. When the display is looked at more closely it is then possible to see the number of segments that have responded and thus the degree of cavitation. On the other hand simply a glance from afar will indicate that no cavitation is present if none of the segments has turned dark.

Figure 4:
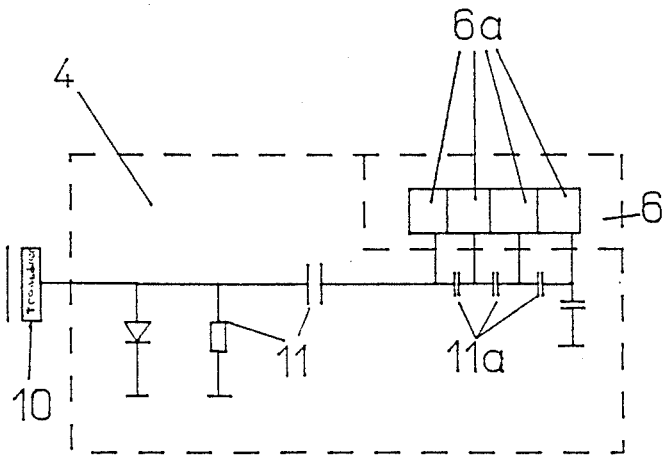
FIG. 4 is a simplified circuit schematic of the circuitry used in the device of FIGS. 1 through 3.

In the case of the circuitry 11 of FIG. 4 the various subcircuits 11*a* are in the form of capacitors 11*a*, which are responsible for the distribution of the AC coming from the vibration transducer 10 with different threshold values among the display segments 6*a*.

The LCD display is particularly suitable as a display with the properties indicated. Such a display furthermore has the advantage that the AC supplied by a commercially available piezoelectric transducer is sufficient in itself for the excitation of the individual display segments. That is to say, no separate power supply is required. The device thus does not require any servicing.

Three small permanent magnets 12 are incorporated in the wall part 1*a* adjacent to the sensing surface 1*b*. These magnets make it possible to hold the device against a pump housing until the adhesive has hardened with which the device is principally held in place.

The vibratory system comprising the vibration transducer 10 and furthermore the wall part 1*a* resiliently connected with the housing 1 and the inertial mass, is so tuned that it resonates when cavitation takes place in the monitored pump. Therefore at such resonant frequency the piezoelectric transducer 10 supplies a particularly AC value.

We claim:

1. A cavitation monitoring device comprising a housing with a rigid wall part responding to vibratory motion and having an external sensing surface for securement on the wall part of a pump housing, an inertial mass arranged in the housing, a piezoelectric vibration transducer held between the inertial mass and the wall part capable of participating in vibration, said transducer being adapted to respond to the vibrations of said wall part and cause vibrations at a predetermined frequency, and electric circuitry with a display observable from a point outside the housing to indicate an AC output of the piezoelectric transducer in excess of a certain threshold.

2. The device as claimed in claim 1 wherein the vibration transducer forms part of an oscillatory system tuned so as to have a resonant frequency corresponding to cavitation in said pump.

3. The device as claimed in claim 1 wherein said display comprises a plurality of adjacently located display segments and said circuitry comprises a plurality of subcircuits, equal in number to the number of display segments and set to different threshold values and each connected with a respective different one of said segments.

4. The device as claimed in claim 3 wherein said display is an LCD display.

5. The device as claimed in claim 4 wherein the display segments are contiguous and appear as dark patches when the respective threshold value thereof is exceeded.

6. The device as claimed in claim 4 wherein the display is adapted to respond to an unamplified output voltage of the vibration transducer.

7. The device as claimed in claim 6 wherein said display segments are arranged along an arc side by side.

8. The device as claimed in claim 6 wherein the display segments are aligned linearly.

9. The device as claimed in claim 1 comprising at least one permanent magnet incorporated in said housing for holding said wall part, capable of participating in vibration, on a ferromagnetic part of said pump housing.

* * * * *